United States Patent [19]

Saffley

[11] 4,286,446

[45] Sep. 1, 1981

[54] MACHINE CONTROL APPARATUS

[75] Inventor: Edgar F. Saffley, Florissant, Mo.

[73] Assignee: ACF Industries, Inc., New York, N.Y.

[21] Appl. No.: 45,603

[22] Filed: Jun. 5, 1979

[51] Int. Cl.[3] ..... B21B 33/00; B21D 55/00; F16D 71/00

[52] U.S. Cl. ..... 72/5; 72/14; 72/274; 192/125 A

[58] Field of Search ..... 72/14, 4, 5, 15, 30, 72/274; 192/125 A

[56] References Cited

U.S. PATENT DOCUMENTS

| | | | |
|---|---|---|---|
| 1,114,616 | 10/1914 | Humphrey | 72/5 |
| 1,265,049 | 5/1918 | Carroll | 72/5 |
| 2,219,811 | 10/1940 | Friedman | 72/30 |
| 2,263,246 | 11/1941 | Morgan | 72/5 |
| 2,349,104 | 5/1944 | Morgan | 72/5 |
| 2,360,741 | 10/1944 | Symmes | 72/5 |
| 2,487,187 | 11/1949 | Seifried et al. | 192/125 A |
| 2,667,134 | 1/1954 | Jeckert | 192/125 A |

*Primary Examiner*—Daniel C. Crane

*Attorney, Agent, or Firm*—J. Joseph Muller

[57] ABSTRACT

A machine draws stock from a source to a first work station at which a first operation is performed on the stock. The stock is then delivered to a second work station so a second operation may be performed on the stock. The machine has an electromechanical system which drives the machine and a switch energizes and deenergizes the system. The stock is engaged by a lever arm as it moves toward the first work station, the lever arm being held in a first position when engaging the stock and moving from the first position toward a second position when the end of the stock is reached. A contact bar moves the switch from its "on" to its "off" position to deactivate the electromechanical system and terminate the drawing of stock. The lever arm and the contact bar are interconnected so movement of the lever arm from its first position to its second position is transmitted to the contact bar. The contact bar moves the switch to its "off" position in response to the movement of the lever arm whereby the electromechanical system is deactivated and the drawing of stock terminated.

4 Claims, 3 Drawing Figures

MACHINE CONTROL APPARATUS

BACKGROUND OF THE INVENTION

This invention relates to machine control apparatus and, more particularly, to apparatus for stopping the feed of stock to a machine when the end of the stock is sensed.

One step in the production of automobile carburetors involves the manufacturing of fuel metering rods which are installed in a fuel bowl of the carburetor to control fuel flow. A machine for manufacturing fuel metering rods typically employs a coil of stock which is fed first to a straightening unit so minor variations in the stock can be corrected. After straightening, the stock is fed to a forming unit containing a series of tools which neck down the stock at appropriate sections to form the fuel metering rod. After this forming step has been accomplished, the resultant fuel metering rod is severed from the remainder of the stock and each rod is collected in a bin from which it is taken to a carburetor assembly line.

One problem encountered with such machines involves damage to the forming tools when the end of a coil of stock is not sensed or observed in time for the operator of the machine to stop the machine so the end of the coil is fed into the straightening unit. When this occurs, a reciprocal carriage within the straightening unit may force the end of the stock forward and, in so doing, damage the forming tools. As a consequence, the forming tools have to be replaced, which is not only costly, but adds to equipment-down time and may disrupt assembly line operations. Machines of the type described may come equipped with an electrical stop device, however, such devices are expensive.

SUMMARY OF THE INVENTION

Among the several objects of the present invention may be noted the provision of apparatus for sensing the end of a length of stock fed to a fuel metering rod forming machine and for stopping the operation of the machine when the end of the length of stock is sensed; the provision of such apparatus which performs its operation without otherwise interfering with the normal operation of the machine; the provision of such apparatus which is readily adaptable to the machine; and the provision of such apparatus which is low in cost and readily installed on the machine.

Briefly, apparatus of the present invention controls a machine drawing stock from a source thereof to a first work station at which a first operation is performed on the stock, the stock being delivered from the first work station to a second work station as the first operation is completed so a second operation may be performed on the stock at the second work station. The machine has an electromechanical system which drives the machine to perform the work at the work station and move the stock, the electromechanical system including a switch for energizing and deenergizing the system. The apparatus comprises means engaging the stock as it moves toward the first work station, the engaging means being held in a first position when engaging the stock and moving from the first position toward a second position when the end of the stock is reached. Means are provided for moving the switch from an "on" to an "off" position to deactivate the electromechanical system and terminate the drawing of stock, and the engaging means and the moving means are interconnected so movement of the engaging means from its first position to its second position is transmitted to the moving means. The moving means moves the switch to its "off" position in response to the movement of the engaging means whereby the electromechanical system is deactivated and the drawing of stock terminated. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
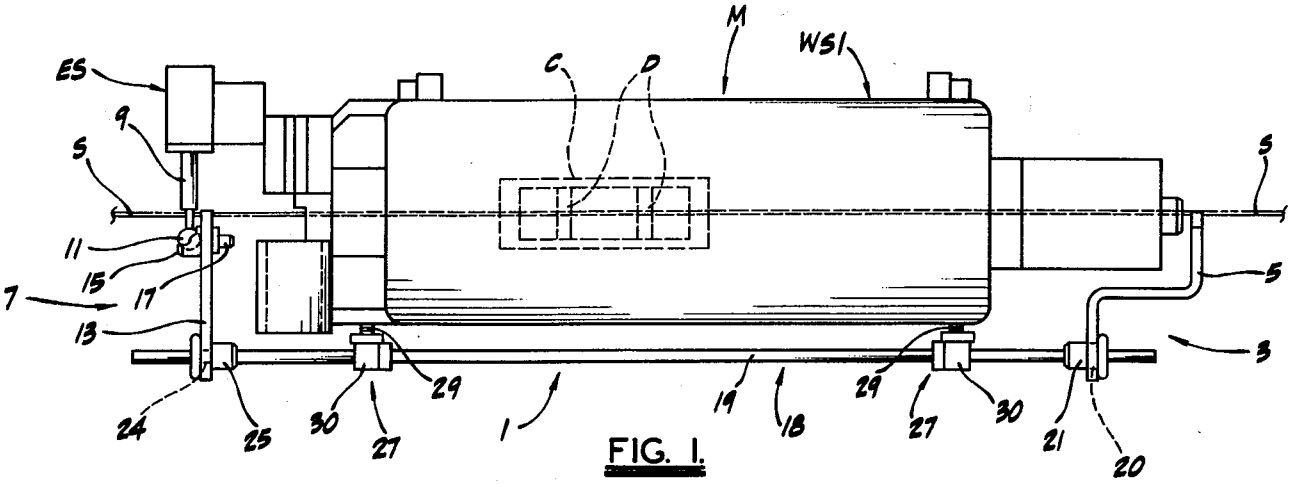
FIGS. 1 and 2 are top plan and front elevational views respectively of a machine incorporating the apparatus of the present invention.
Figure 2:
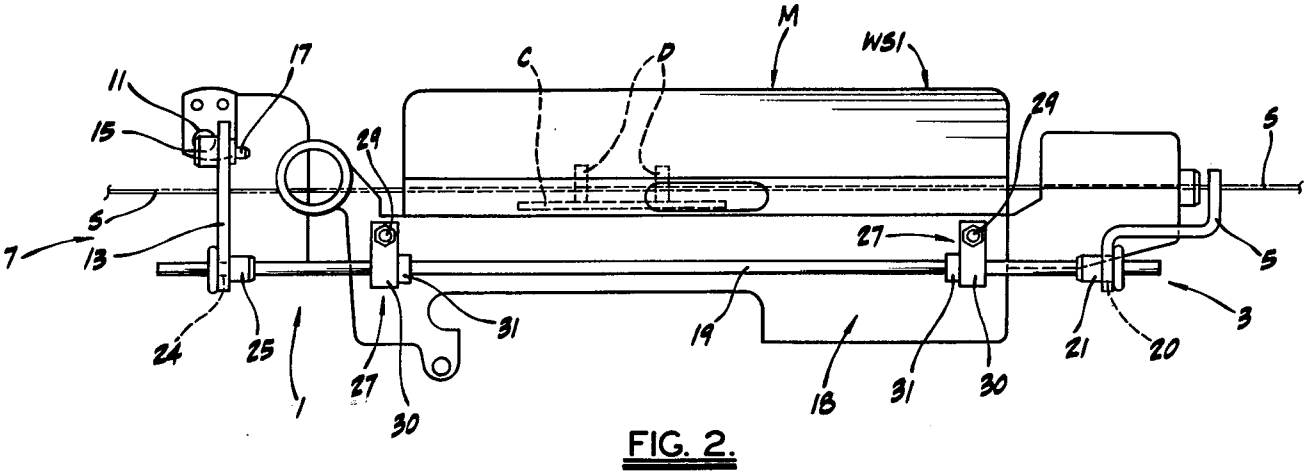
Figure 3:
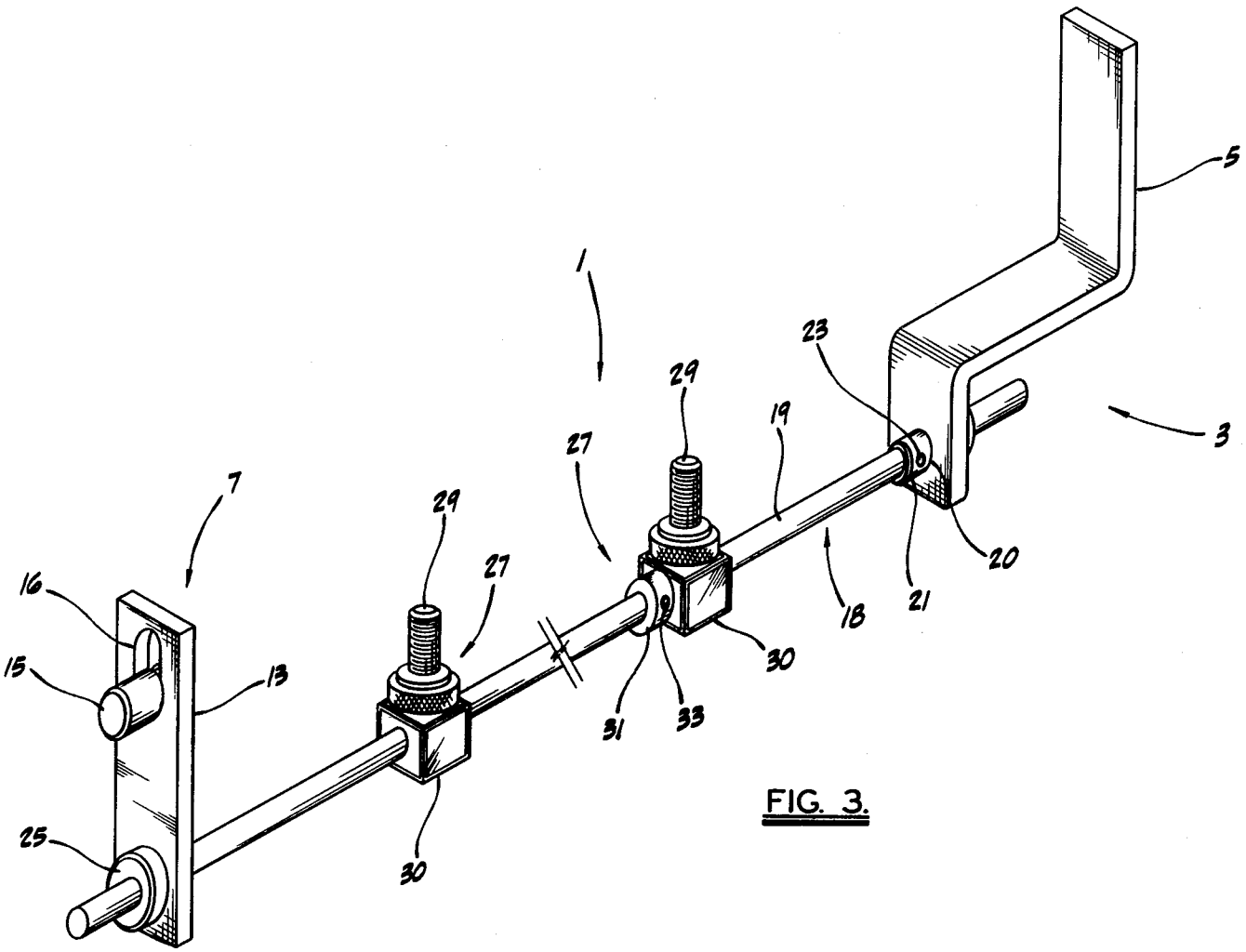
FIG. 3 is a perspective view of the apparatus of the present invention.

Referring to the drawings, apparatus of the present invention is indicated generally 1. The apparatus controls a machine M which draws stock S from a source such as a coil of stock (not shown) to a first work station WS1 at which a first operation is performed on the stock. The stock is moved from the first work station to a second work station (not shown) as the first operation on the stock is completed. A second operation is then performed on the stock at the second work station. Machine M has an electromechanical system (not shown) which drives the machine to perform the work at the work stations and move the stock. The electromechanical system includes a switch ES for energizing and deenergizing the electromechanical system. Specifically, machine M is used to produce fuel metering rods for use in carburetors installed on automobile engines. Stock S is initially coiled and the leading end of the stock is introduced into the machine at the right end of the machine as shown in FIGS. 1 and 2. The stock is then delivered to work station WS1 which includes a reciprocal carriage C having straightening dies D mounted on the carriage for straightening the stock. The straightening operation of the stock is performed during the left-to-right travel of the carriage. During the right-to-left travel of the carriage, the stock is drawn forward through the machine toward the second work station at which a series of tools (also not shown) progressively reduce the diameter along a length of stock to produce a fuel metering rod. After the diameter reduction operation is performed, the end of the length of stock is cut off and falls into a bin (not shown) for collection. A machine M of the type described is produced by ESCO S. A. of Geneva, Switzerland, under their model designation ESCOMATIC Type D2 and Type D4.

One problem encountered in using machine M occurs when the end of a coil of stock is reached. If the end of the coil reaches work station WS1, it may get caught between dies D and be pushed forward during the right-to-left travel portion of the carriage cycle and, as a consequence, the diameter reducing tools at the second work station may be damaged. As a result, the diameter reducing tools may have to be replaced, which both adds to production costs by increasing machine-down time and increasing material replacement costs.

Apparatus 1 of the present invention is designed to prevent the above. As shown in the drawings, apparatus 1 comprises means 3 for engaging the stock as it moves toward the first work station (that is, prior to its entry into the right end of machine M, as shown in FIGS. 1 and 2). Engaging means 3 comprises a lever arm 5, the side of which bears against stock S as long as there is stock to be drawn into the machine. The lever arm is held in a first position when engaging the stock and moves from this first position toward a second position when the end of the stock moves past the lever arm.

Apparatus 1 further includes means 7 for moving switch ES from an "on" to an "off" position, and thus deactivate the electromechanical system and terminate the drawing of stock into machine M. Switch ES has a switch arm 9 extending outwardly from machine M, the end of the switch arm terminating in a ball or knob 11. Moving means 7 comprises a contactor 13 for contacting switch arm 9 to move the switch from its "on" to its "off" position. Contactor 13 is a bar having a knob 15 secured to it at one end. Knob 15 bears against switch arm 9 and specifically against knob 11 at the outer end of the switch arm.

The position of knob 15 relative to switch arm 9 and, more particularly, knob 11 on the end of the switch arm, is adjustable. For this purpose, bar 13 has a longitudinal slot 16 and knob 15 is movable in this slot. Knob 15 has an adjustment screw 17 which, when loosened, permits the knob to be moved back and forth in the slot to adjust its position relative to the switch arm. Thus, when the end of the stock is sensed and lever 5 moves from its first to its second position, bar 13 may exert sufficient force on the end of switch arm 9 to move switch ES to its "off" position.

A means 18 interconnects engaging means 3 and moving means 7 to transmit movement of the engaging means from its first to its second position to the moving means. Moving means 18 comprises a rod 19 and engaging means 3 is attached to one end (the right end) of the rod while moving means 7 is attached to the other end (the left end) of the rod. Specifically, lever 5, which is S-shaped, has an opening 20 at one end, and a collar 21 is sized to fit through this opening. This fits over rod 19 and a bolt or screw 23 is used to secure the collar to the right end of the rod. Similarly, the end of bar 13 opposite knob 15 has an opening 24 through which a collar 25 fits, and the collar is secured to the left end of rod 19 also by a bolt or screw.

As shown in FIG. 1, bar 19 is positioned parallel to and spaced apart from machine M and, more particularly, the path of stock S through the machine. A means 27 is provided for adjusting the position of rod 19 relative to machine M. Means 27 comprises a pair of spaced apart screws 29 carried in holders 30 which are attached to rod 19 by collars 31 and screws 33 in the same manner previously described. The inner end of each screw abuts the front face of machine M and each screw is separately adjustable to move the appropriate end of rod 19 either closer to or farther from the front face of the machine.

In operation, apparatus 1 is positioned so lever 5 bears against the side of the stock being fed into the right end of machine M. At the same time, knob 15 on the outer end of bar 13 is adjusted relative to knob 11 on switch arm 9. As long as stock is being fed into machine M, lever 5 is held in a first position contacting the stock material. When the end of the stock is reached, lever 5 rotates by gravity from its first position toward a second position. This movement is transmitted via arm 19 to bar 13 and the bar rotates in the same direction as lever 5. As a consequence, knob 15 on bar 13 bears against knob 11 on the outer end of switch arm 9 and moves electric switch ES from its "on" to its "off" position. This deactivates the electromechanical system controlling the operation of machine M and the drawing of stock S into the machine and the drawing of the stock material terminates. The result is that machine M stops before the end of the stock material reaches carriage C. The operator of the machine can now replace the stock material remaining in the machine with the forward end of a new piece of stock S, and the danger of the forming dies being damaged is eliminated.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. Apparatus for controlling a machine drawing stock from a source thereof to a first work station at which a first operation is performed on the stock, the stock being delivered from the first work station to a second work station as the first operation is completed so a second operation may be performed on the stock at the second work station, the machine having an electromechanical system which drives the machine to perform the work at the work station and move the stock, the electromechanical system including a switch for energizing and deenergizing the system, and the switch having a contactor arm extending outwardly from the machine, the apparatus comprising:

a lever arm bearing against the stock as it moves toward the first work station, the lever being held in a first position when engaging the stock and rotatably movable from the first toward a second position when the end of the stock is reached;

a contactor for moving the contactor arm of the switch to turn the switch from "on" to "off" and deactivate the electromechanical system thereby terminating the drawing of stock; and, a rod rotatably interconnecting the lever and the contactor for transmitting movement of the lever from its first position toward its second position to the contactor, the contactor moving the switch to its "off" position in response to movement of the lever, the lever being attached to one end of the rod, the contactor being attached to the other end of the rod and the rod being positioned substantially parallel to the path of stock through the machine so that said rod is rotatable about an axis extending parallel to said stock path.

2. Apparatus as set forth in claim 1 wherein the contactor includes a bar, one end of which is attached to the rod and a knob secured to the other end of the bar and contacting the contactor arm.

3. Apparatus as set forth in claim 2 further including means for changing the position of the knob relative to the contactor arm.

4. Apparatus as set forth in claim 3 wherein the rod further includes means for adjusting the position of the rod relative to the machine.

* * * * *